US007537823B2

(12) United States Patent
Nakashima et al.

(10) Patent No.: US 7,537,823 B2
(45) Date of Patent: May 26, 2009

(54) HIGH-WHITENESS HYGROSCOPIC FIBER

(75) Inventors: Shigeru Nakashima, Okayama (JP); Noriyuki Kohara, Kurashiki (JP); Masao Ieno, Okayama (JP)

(73) Assignee: Japan Exlan Company Limited, Osaka (JP)

( * ) Notice: Subject to any disclaimer, the term of this patent is extended or adjusted under 35 U.S.C. 154(b) by 332 days.

(21) Appl. No.: 10/380,510

(22) PCT Filed: Nov. 2, 2001

(86) PCT No.: PCT/JP01/09622

§ 371 (c)(1),
(2), (4) Date: Mar. 14, 2003

(87) PCT Pub. No.: WO02/059415

PCT Pub. Date: Aug. 1, 2002

(65) Prior Publication Data

US 2004/0010857 A1 Jan. 22, 2004

(30) Foreign Application Priority Data

Jan. 26, 2001 (JP) ..... 2001-017856

(51) Int. Cl.
*D01F 8/04* (2006.01)

(52) U.S. Cl. ..... 428/221; 428/311.51; 428/351; 428/355 AC; 57/245; 442/76

(58) Field of Classification Search ..... 8/115.65, 8/115, 65, 115.51; 428/364, 394, 395, 221, 428/311.51, 351, 355 AC; 264/182, 345; 57/904, 245; 510/285, 286; 442/76
See application file for complete search history.

(56) References Cited

U.S. PATENT DOCUMENTS

| | | | | | |
|---|---|---|---|---|---|
| 3,299,007 | A | * | 1/1967 | Suling et al. | 526/229 |
| 3,769,060 | A | * | 10/1973 | Ida et al. | 428/196 |
| 5,853,879 | A | * | 12/1998 | Takamiya et al. | 428/364 |
| 6,046,119 | A | * | 4/2000 | Kaibe et al. | 442/76 |
| 6,736,856 | B1 | * | 5/2004 | Takahashi et al. | 8/115.51 |

FOREIGN PATENT DOCUMENTS

| | | | |
|---|---|---|---|
| EP | 1 111 122 | | 6/2001 |
| JP | 11-81130 | | 3/1999 |
| JP | 11-081130 | * | 3/1999 |
| JP | 2000-303353 | * | 10/2000 |

OTHER PUBLICATIONS

Elenor Jones and Michael S. Garley, Traveling Waves in Autocatalytic Oxidations by Nitric Acid, 1990, React.Kinet.Catal. Lett., vol. 42, No. 2, 395-399.*

* cited by examiner

*Primary Examiner*—Lorna M Douyon
*Assistant Examiner*—Tri V Nguyen
(74) *Attorney, Agent, or Firm*—Wenderoth, Lind & Ponack, L.L.P.

(57) ABSTRACT

A moisture absorbing hygroscopic fiber having high whiteness, characterized in that (1) acrylic fiber comprising acrylonitrile copolymer where a (meth)acrylate compound as a copolymer component is less than 5% by weight is treated with a hydrazine compound whereby introduction of crosslink and increase in nitrogen content to an extent of 1.0 about 10.0% by weight is carried out, (2) treatment with an aqueous solution of alkaline metal salt is carried out whereby carboxyl group of a metal salt type by which CN group is hydrolyzed is produced in an amount of 4.0 about 10.0 meq/g and (3) a reducing treatment by a reduction treatment agent selected from a group consisting of hydrosulfite, thiosulfate, sulfite, nitrite, thiourea dioxide, and ascorbate compound is carried out.

2 Claims, No Drawings

HIGH-WHITENESS HYGROSCOPIC FIBER

BACKGROUND OF THE INVENTION

1. Field of the Invention

The present invention relates to a moisture absorbing fiber. More particularly, it relates to a moisture absorbing fiber having high whiteness and an excellent color stability showing an excellent processing ability in spite of its anti-inflammability and antibacterial property, having further improved whiteness as compared with the conventional products and showing almost no color change even when bleaching treatment during dyeing step and washing are repeated.

2. Description of the Related Art

As a means for removal of moisture from air using fibrous materials, there has been proposed a means of Japanese Patent Laid-Open No. 01/299,624 where a deliquescent salt is impregnated with a highly water-absorbing fiber. The fiber obtained by such a means has practical properties that it is easy for making into knitting, textile, nonwoven fabric, etc., has quick moisture absorbing and desorbing rates and shows no detachment of moisture absorbent. However, its fiber surface is hydrogel and, therefore, it becomes tacky upon absorption of moisture, its application especially to wall paper and cotton fillings for bedclothes is difficult and it does not satisfy anti-inflammability and antibacterial property which have been increasing as social demands.

As a means for solving such problems, there has been a proposal for a means of Japanese Patent Laid-Open No. 05/132,858. However, in such a method, when amount of salt-type carboxyl group is more than 4.5 meq/g, tensile strength becomes 0.9 cN/dtex or less which is an insufficient fiber property for subjecting to various treatments and that is obstacle for further increase of hygroscopicity. When an increase in nitrogen content introduced by the treatment with a hydrazine compound for preparing a highly moisture-absorbing fiber where fiber strength is 0.9 cN/dtex or more is made more than 8.0% by weight, there is a problem that amount of introduction of salt-type carboxyl group after hydrolysis becomes little whereby hygroscopicity becomes low.

There is another disadvantage that the fiber obtained by the method of Japanese Patent Laid-Open No. 05/132,858 shows dark pink color to dark brown color and, therefore, field in which the fiber is able to be utilized is limited. In the invention for Japanese Patent Laid-Open No. 09/158,040 which has been proposed for overcoming such a disadvantage, there is disclosed that an acidic treatment A is carried out after the cross-linking treatment using a hydrazine compound and that an acidic treatment B is carried out after the hydrolyzing treatment with an alkali whereby considerable improvement in whiteness can be achieved. However, the current status is that even such an art is unable to give sufficient satisfaction to the field where a strict whiteness is demanded. In Japanese Patent Laid-Open No. 2000/303,353, there is disclosed a method for improving the whiteness where the hydrolyzing treatment is carried out in a non-oxygen atmosphere. However, the current status is that the fiber obtained by the said method is colored when oxidative bleaching treatment during dyeing step and washing are repeated and, therefore, it has a disadvantage of poor color stability.

An object of the present invention is to provide fiber in which the disadvantage that color is unstable in such conventional moisture absorbing fibers is improved where basic physical property demanded to fiber and characteristic to be owned by moisture-absorbing fiber are still maintained and also to provide a method for the manufacture of such a fiber.

SUMMARY OF THE INVENTION

The present inventors have carried out an intensive investigation for improvement of color stability on the basis of the art disclosed in Japanese Patent Laid-Open No. 2000/303,353 and, as a result, they have found that moisture absorbing fiber having high whiteness where the color is stable is able to be prepared when a specific acrylic fiber is adopted as the material for the said fiber whereupon the present invention has been achieved.

The above-mentioned object of the present invention can be achieved by a method for the manufacture of moisture absorbing fiber having high whiteness which is characterized in that an acrylic fiber comprising acrylonitrile polymer where a (meth)acrylate compound as a copolymer component is less than 5% by weight is subjected to crosslink introduction treatment using a hydrazine compound, to hydrolysis and to reducing treatment and the object can be achieved in better manner in the case of the manufacturing method where an acid treatment is carried out between the crosslink introducing treatment and the hydrolyzing treatment.

The object can be more advantageously achieved by a method for the manufacture of moisture absorbing fiber having high whiteness where (1) acrylic fiber comprising acrylonitrile copolymer where a (meth)acrylate compound as a copolymer component is less than 5% by weight is treated with a hydrazine compound whereby introduction of crosslink and increase in nitrogen content to an extent of 1.0~10.0% by weight is carried out, (2) treatment with an aqueous solution of alkaline metal salt is carried out whereby carboxyl group of a metal salt type by which CN group is hydrolyzed is produced in an amount of 4.0~10.0 meq/g and (3) a reducing treatment by a reduction treatment agent selected from a group consisting of hydrosulfite, thiosulfate, sulfite, nitrite, thiourea dioxide, ascorbate and hydrazine compound is carried out. Incidentally a method where a treatment with acid is conducted after (1) and before (2) is similarly carried out as above is adoptable of course.

The object can be more advantageously achieved by a method for the manufacture of moisture absorbing fiber having high whiteness where a treatment with acid is further carried out after the reducing treatment to make the said metal-type carboxyl group into an H type and then a treatment with a metal salt selected from Li, Na, K, Ca, Mg, Ba and Al is carried out so that a part of the said H-type carboxyl group is made into a metal salt type (hereinafter, referred to as a salt-type adjusting treatment) so that the molar ratio of H type/metal salt type is adjusted to 90/10~0/100.

The present invention further includes a moisture absorbing fiber having high whiteness which is manufactured by the above-mentioned manufacturing method where lightness is 8 or more but less than 10, chroma is 4 or less, hue is 2.5R~7.5Y in terms of whiteness and discoloration of the fiber after washing according to a JIS-L0217-103 method ("Attack" manufactured by Kao was used as detergent) for five times and being evaluated by a grey scale for assessing staining according to JIS-L0805 (hereinafter, the characteristic by the present evaluating method is called durability against washing) is grade 3-4 or higher; a moisture absorbing fiber having hig h whiteness where further discoloration of the fiber after bleaching with hydrogen peroxide where a bleaching treatment is carried out under the condition of 0.5% by weight of hydrogen peroxide concentration, pH 10 by NaOH and bath ratio of 1/50 at 80° C. for 60 minutes and being evaluated by a grey scale for assessing staining according to JIS-L0805 (hereinafter, the characteristic by the present evaluating method is called durability against bleaching) is grade 3 or more; and a moisture absorbing fiber having high whiteness where further discoloration of the fiber after being allowed to stand in the co-presence of water in an amount of more than the saturated water absorption (hereinafter, such a state may be referred to as under moisture) at 80° C. for 16 hours and being evaluated by a grey scale for assessing staining according to JIS-L0805 (hereinafter, the characteristic according to this evaluating method is referred to as stability upon being allowed to stand) is grade 3-4 or more.

DETAILED DESCRIPTION OF THE PREFERRED EMBODIMENTS

The present invention will now be illustrated in detail as hereunder. The present invention relates to cross-linked acrylic fiber in which a starting acrylonitrile fiber (hereinafter, that maybe abbreviated as acrylic fiber) therefor is fiber formed from an acrylonitrile (hereinafter, referred to as AN) polymer containing 40% by weight or more or, preferably, 50% by weight or more of AN and it may be in any of forms of short fiber, tow, yarn, knitted/woven things, nonwoven fabric, etc. or may be an intermediate product during the manufacturing step, waste fiber, etc. The AN polymer may be any of an AN homopolymer and a copolymer of AN with other monomer and, although it is most preferred to avoid the use of (meth) acrylate compound as a monomer to be copolymerized with AN, it is necessary that the amount of the said compound is 5% by weight or less or, more preferably, 3.5% by weight or less if and when it is used unavoidably. Incidentally, the expression reading (meth) means both acrylate and methacrylate. Examples of the said ester compound which may be a copolymerizing component if it is less than 5% by weight are methyl (meth) acrylate, ethyl (meth) acrylate, butyl (meth)acrylate, dimethylaminoethyl (meth)acrylate and diethylaminoethyl (meth)acrylate. With regard to other copolymerizing components, there is no particular limitation so far as it is a monomer which is able to be copolymerized with AN including a monomer containing sulfonic acid group such as methallylsulfonic acid and p-styrene sulfonic acid and salt thereof and monomers such as styrene, vinyl acetate, etc. although copolymerization with 5~20% by weight of a vinyl ester compound represented by vinyl acetate is preferred. Examples of such a vinyl ester are vinyl acetate, vinyl propionate and vinyl butyrate.

The said acrylic fiber is subjected to a treatment for the introduction of crosslink by a hydrazine compound whereby crosslink is formed in such a sense that it is no longer soluble in a solvent for acrylic fiber and, at the same time and as a result thereof, an increase in nitrogen amount is resulted although there is no particular limitation for the means therefor. Although the means by which an increase in nitrogen amount by such a treatment is able to be adjusted to 1.0~10% by weight is preferred, the means whereby an increase in nitrogen amount is 0.1~1.0% by weight may be adopted so far as it is a means by which the moisture absorbing fiber with high whiteness of the present invention can be prepared. With regard to a means by which an increase in the nitrogen amount is able to be adjusted to 1.0~10% by weight, the means in which a treatment is carried out in an aqueous solution containing 5~60% by weight of a hydrazine compound at the temperature of 50~120° C. for 5 hours or less is preferred from an industrial view. In order to make the increase in the nitrogen amount low, the conditions shall be made milder according to the teaching of reaction technology. Here, an increase in the nitrogen amount means the difference between the nitrogen amount contained in the starting acrylic fiber and the nitrogen amount contained in the acrylic fiber into which crosslink is introduced by a hydrazine compound.

With regard to the hydrazine compound used here, there is no particular limitation and its examples are compounds having plural amino groups such as hydrazine hydrate, hydrazine sulfate, hydrazine hydrochloride, hydrazine hydrobromide and hydrazine carbonate as well as ethylenediamine, guanidine sulfate, guanidine hydrochloride, guanidine phosphate and melamine.

The fiber which is subjected to a treatment for introduction of crosslink by such a hydrazine compound may be treated with an acid. Such a treatment contributes in improvement of color stability of the fiber. Examples of the acid used here are an aqueous solution of mineral acid such as nitric acid, sulfuric acid and hydrochloric acid and organic acid although there is no particular limitation. Before such a treatment, the hydrazine compound remained in the cross-linking treatment is to be well removed. Although there is no particular limitation for the condition of such a treatment with acid, an example is that the fiber to be treated is dipped in an aqueous solution where the acid concentration is about 5~20% by weight or, preferably, 7~15% by weight at the temperature of 50~120° C. for 2~10 hours.

The fiber subjected to a treatment for the introduction of crosslink by the hydrazine compound or further treated with acid is then hydrolyzed with an aqueous solution of alkaline metal salt. As a result of such a treatment, hydrolysis proceeds for CN group which is not participated in the crosslink introducing treatment by the treatment of acrylic fiber with the hydrazine compound but is remained there and for CN group which remains when the treatment with acid is carried out after the cross-linking treatment step as well as for $CONH_2$ group which is partially hydrolyzed in the treatment with acid. Those groups form carboxyl group as a result of hydrolysis but, since the chemical agent used is an alkaline metal salt, there is at last formed a carboxyl group of a metal salt type. Examples of the alkaline metal salt used here are alkaline metal hydroxide, alkaline earth metal hydroxide and alkaline metal carbonate. Although there is no particular limitation for the concentration of the alkaline metal salt used, it is preferred in view of industry and property of the fiber that the treatment in an aqueous solution of 1~10% by weight or, more preferably, 1~5% by weight is carried out at the temperature of 50~120° C. for 2~10 hours.

Here, examples of the metal salt type or the salt type of carboxyl group are alkaline metal such as Li, Na and K and alkaline earth metal such as Mg, Ca and Ba. Degree of progress of hydrolysis or, in other words, the produced amount of carboxyl group of a metal salt type is to be controlled to 4~10 meq/g and that can be easily carried out by a combination of concentration of the chemicals, temperature and treating time during the above-mentioned treatment. Incidentally, in the fiber which is subjected to such a hydrolyzing step, the CN group may not be present. If the CN group is present, there is a possibility of adding further function by utilizing the reactivity thereof.

With regard to an agent for the reducing treatment to be used in a reducing treatment which is to be carried out next, chemical agent(s) which is/are one or more selected from a group consisting of hydrosulfite, thiosulfate, sulfite, nitrite, thiourea dioxide, ascorbate and hydrazine compound may be advantageously used. Although there is no particular limitation for the conduction of the said reducing treatment, an examples is that the fibre to be treated is dipped in an aqueous solution of about 0.5~5% by weight of the chemical agent at the temperature of 50° C.~120° C. for 30 minutes to 5 hours.

The said reducing treatment may be carried out together with the above-mentioned hydrolysis or may be carried out after the hydrolysis.

The moisture absorbing fiber with high whiteness of the present invention is manufactured as such and, with the purpose of more stabilization of the color, it is preferred that the fiber after subjecting to the above reducing treatment step is subjected to a treatment with acid to convert the said carboxyl group of a metal salt type to an H type and then subjected to a treatment with metal salt selected from Li, Na, K, Ca, Mg, Ba and Al to convert a part of the said H-type carboxyl group into a metal salt type (treatment for adjustment of the salt type) so as to adjust the molar ratio of (H type)/(metal salt type) to 90/10~0/100.

Examples of the acid used for the treatment with acid are an aqueous solution of mineral acid such as nitric acid, sulfuric acid and hydrochloric acid and organic acid although there is no particular limitation therefor. Conditions for the said treatment with acid are not particularly limited and an example is that the fiber to be treated is dipped in an aqueous solution of acid concentration of about 1~10% by weight or, preferably, 5~10% by weight at the temperature of 50~120° C. for 2~10 hours.

With regard to the kind of the metal for the metal salt adopted in the treatment for adjusting the salt type is selected from Li, Na, K, Ca, Mg, Ba and Al and the particularly recommended ones are Na, K, Ca, Mg, etc. With regard to the kind of the salt, a water-soluble salt of those metals may be used and its examples are hydroxide, halide, nitrate, sulfate and carbonate. To be more specific, with regard to the representative ones for each metal, the preferred ones are NaOH and $Na_2CO_3$ as Na salt, KOH as K salt and $Ca(OH)_2$, $Ca(NO_3)_2$ and $CaCl_2$ for Ca salt.

Molar ratio of the H type to the metal salt type of the carboxyl group is within the above-mentioned range and is appropriately set together with the kind of the metal depending upon the function which is to be given to the fiber. In a specific practice of the treatment for adjusting the salt type, there are a method where an aqueous solution of 0.2~30% by weight of metal salt is prepared in a treating bath and the fiber to be treated is dipped therein at 20° C.~80° C. for about 1~5 hour(s), a method where the said aqueous solution is sprayed, etc. In order to adjust to the above-mentioned ratio, a treatment for the adjustment of salt type in the co-presence of a buffer is preferred. With regard to the buffer, that where the pH buffering region is 5.0~9.2 is advantageous. Kind of the metal salt of the metal-type carboxyl group is not limited to one but two or more kinds may be mixed and present.

The moisture absorbing fiber with high whiteness of the present invention as mentioned hereinabove is a moisture absorbing fiber where processing ability is excellent, whiteness is further improved as compared with the conventional product and color stability is also excellent in spite of the fact that the fiber still possesses hygroscopic property, anti-inflammability and antibacterial property.

The present invention relates to the fiber which is manufactured by the above-illustrated steps and has a big characteristic feature that the monomer composition of the starting acrylic fiber is stipulated. When the said acrylic fiber is adopted, the result is not only that moisture absorbing fiber having excellent color stability is achieved but also that the fiber giving no redness which is most unfavorable in its use as a clothing.

When the treatment for adjusting the salt type is carried out using a substance having low water solubility such as compounds of metal, e.g. Ca, Mg and Ba, there are some difficulties in increasing the metal salt type in the molar ratio of H type/metal salt type from the H-type carboxyl group in the said step. In that case, it is recommended that, as a pretreatment for the treatment of adjusting the salt type after the treatment with acid, carboxyl group which is made into an H type in the step of treating with acid is treated with an aqueous solution of sodium hydroxide, potassium hydroxide or the like so that the pH of the said carboxylic acid is adjusted or, in other words, neutralized (pH=about 5~9). As a result of such a treatment, the carboxyl group after the neutralization treatment is in a state where H type is co-present together with Na or K type and, therefore, the next treatment for adjusting the salt type easily proceeds because of exchange of Ca, etc. with Na or K whereby the above-mentioned difficulty is solved.

The moisture absorbing fiber with high whiteness of the present invention prepared by the above-illustrated manufacturing method is characterized in its whiteness and color stability and, to be more specific, it is possible to make lightness 8 or more and less than 10, chroma 4 or less, hue 2.5R~7.5Y in terms of whiteness and grade 3-4 or more of durability against washing in terms of color stability. Incidentally, value (grade) of durability against washing was obtained in such a manner that the fiber material was washed with a method mentioned in JIS-L0217-103 method ("Attack" of Kao was used as detergent), the washing treatment was repeated for five times and degree of discoloration of the fiber after the washing from the color of the fiber material before the washing was evaluated by a grey scale for assessing staining according to JIS-L0805.

It is also possible that the durability against bleaching is made grade 3 or more and the stability upon being allowed to stand is made grade 3-4 or more. Here, the value (grade) of durability against bleaching was obtained in such a manner that the fiber material is poured into an aqueous solution of 0.5% by weight of hydrogen peroxide being adjusted to pH 10 with NaOH so as to make the bath ratio of the fiber material to the aqueous solution 1/50 and bleached at 80° C. for 60 minutes and degree of discoloration of the fiber bleached at 80° C. for 60 minutes from the color of the fiber material before the bleaching was evaluated by a grey scale for assessing staining according to JIS-L0805.

The value (grade) of the stability upon being allowed to stand was obtained in such a manner that the sample fiber was dipped in pure water, water was made well contained in the fiber, then the fiber was taken out under such a state that sufficient amount of water for maintaining the saturated water absorption amount even at 80° C., tightly closed in a container where one half or more of the container was vacant, placed in a constant-temperature machine adjusted to 80° C., taken out after 16 hours, dehydrated and dried and degree of discoloration of the resulting fiber from the fiber sample before the treatment was evaluated by a grey scale for assessing staining according to JIS-L0805. Incidentally, saturated water absorption amount is the value where the weight of the well-hydrated sample fiber after drying (at 105° C. for 16 hours) is deducted from the weight of the same fiber after centrifugal dewatering (at 160 G×5 minutes).

In the meanwhile, lightness, chroma and hue used here are dependent upon JIS-Z-8721 for the expression of whiteness. "Lightness" is a characteristic which is discriminated according to the degree of brightness. Thus, non-colored and ideal white is defined as 10 while ideal black is defined as 0 and they are divided and expressed by numerals so that the difference in the sense of lightness is made uniform and numeral of lightness of colored one is made numeral of uncolored one where the sense of brightness is identical with the former. "Chroma" is a characteristic which is discriminated by the degree of chroma of the color where non-colored one is 0 and, as the degree of chroma increases, it is given by numeral in a step-by-step manner. However, even when lightness and chroma are constant, a colored substance has color such as red (R), yellow (Y), green (G), blue (B), purple (P), etc. and a complete expression is not available unless that is characterized. The characteristic which expresses the above is "hue". Thus, "hue" is a characteristic of color for characterizing the property of color sense such as red, green and blue and, since it has a circulation transition of red, yellow, green, blue, purple and reddish purple returning to red, they are arranged in a circular manner to prepare a hue ring and divided into 100 to express by means of numerals. Color change is a value which is evaluated according to grey scale for assessing staining according to JIS-L0805 and, when there is no change at all, the value is grade 5.

As mentioned already, in the invention disclosed in Japanese Patent Laid-Open 2000/303,353, whiteness is improved than before and there are achieved lightness of 8~10, chroma of 1~4 and hue of 7.5 YR~7.5 Y. However, although such a result is achieved, fiber of the said invention colored in red when bleaching with hydrogen peroxide and washing are repeated or after being allowed to stand under moisture at 80° C. for 16 hours. Thus, in the processing stage to the final commercial product or in the using stage, it is noted as red by naked eye and is not recognized to be "white" and, especially in the field of clothing, its application is difficult.

As mentioned above, the fiber of the present invention achieves lightness of 8 or more and less than 10, chroma is 4 or less and hue of 2.5R~7.5 Y and, even after repeated washings, discoloration of the fiber is kept within grade 3-4 or more. Further, even under a bleaching condition with hydrogen peroxide, discoloration of the fiber is grade 3 or more and, even after being allowed to stand under moisture at 80° C. for 16 hours, discoloration of the fiber is grade 3 or more whereby the said fiber is greatly superior to the above-mentioned fiber of Japanese Patent Laid-Open 2000/303,353.

In the meanwhile, with regard to the method for the manufacture of acrylic fiber which is a starting material of the present invention, there is no other limitation than that the monomer composition is that mentioned hereinabove but the means which has been adopted for conventional fiber for clothing may be used.

Although it is preferred to use such a fiber as a starting fiber, it is not always necessary to use the fiber which is subjected to the final step but that which is within the manufacturing step for acrylic fiber or that where a spinning treatment or the like is conducted in the final fiber may be used as well. Particularly when the fiber after elongation and before thermal treatment during the manufacturing steps for acrylic fiber (fiber where a original spinning liquid of AN polymer is spun according to a conventional method and subjected to elongating arrangement but is not subjected to thermal treatment such as drying/tightening or releasing with moisturized heat, etc., particularly the water-swollen gel-like fiber after wet or dry/wet spinning and elongation; degree of swelling with water: 30~150%) is used as the starting acrylic fiber, the result is preferred that there are improvements in dispersing property of the fiber into the treating solution, in permeability of the treating solution into the fiber, etc. whereby introduction of crosslink and hydrolyzing reaction take place uniformly and quickly.

Incidentally, it is preferred in view of apparatus, safety, uniform treatment, etc. that such a starting acrylic fiber is charged in a container equipped with stirring function and temperature controlling function and then the above-mentioned steps are carried out or that plural containers are arranged to continuously conduct the steps. An example for such an apparatus is a dyeing machine.

The fiber of the present invention is a moisture absorbing fiber with high whiteness equipped with strong ductility durable to fibrous treatment and having excellent color stability and heat is also generated upon absorption of moisture. It also has anti-inflammability, antibacterial property, deodorizing property, resistance to chemical, etc. presumably due to a cross-linked structure containing nitrogen and to a high moisture-absorbing rate. Therefore, the fiber of the present invention is advantageously applied to the use including for clothing in general such as underwear, undershirt, lingerie, pajama, clothing for babies, girdle, brassier, gloves, socks, tights, leotard and trunks and also for inner and outer clothing such as sweater, trainer, polo shirt, suit, sportswear and scarf, handkerchief, towel, curtain, ticking, inner filler and packing fiber for bedclothes, pillow, cushion, stuffed toy, etc., sheet, blanket, pad and other bedding materials, carpet, mattress, supporter, core, insole for shoes, slippers, wallpaper and other materials for house, medical field, and the like.

Although the reason why the moisture absorbing fiber having high whiteness according to the present invention gives high whiteness and improves the color stability has not been fully clarified yet, that will be presumably to be as follows. Thus, when the starting acrylic fiber contains 5% by weight or more (meth)acrylate compound as a copolymerizing component in the introduction of a cross-linking structure by a hydrazine compound, the hydrazine compound reacts with the carbonyl carbon moiety of the said copolymerizing component and, as a result, an oxygen-containing bond is introduced into the cross-linked structure and coloration is apt to take place whereby the color stability is deteriorated while, in accordance with the present invention, formation of the said bond is suppressed during the material stage whereby coloration is suppressed and, even by bleaching treatment using hydrogen peroxide, repeated washing treatment, etc., coloration hardly takes place.

EXAMPLES

The present invention will now be more specifically illustrated by way of the following Examples. Part(s) and % in the Examples are given on the basis of weight unless otherwise mentioned. Incidentally, amount of carboxyl group of a metal salt type, whiteness and moisture absorbing rate were determined by the following methods.

(1) Amount of carboxyl group of a metal salt type (meq/g) Well-dried fiber (about 1 g) after hydrolysis was precisely weighed (X grams), 200 ml of water were added thereto, a 1 mol/l aqueous solution of hydrochloric acid was added to the above mixture warmed at 50° C. to adjust to pH 2 and a titration curve was determined by a conventional manner using a 0.1 mol/l aqueous solution of sodium hydroxide. From the said titration curve was determined the amount (Y cc) of the sodium hydroxide solution consumed thereby and then amount of carboxyl group (meq/g) was calculated by the following formula.

$$(\text{Amount of carboxyl group})=0.1\,Y/X$$

In the meanwhile, a titration curve was determined in the same manner as above except that adjustment to pH 2 by addition of a 1 mo l/l aqueous solution of hydrochloric acid was not conducted during the above operation for the measurement of carboxyl group amount whereupon amount (meq/g) of carboxyl group of an H type was determined.

From those results, amount of carboxyl group of a metal salt type was calculated from the following formula.

(Amount of carboxyl group of metal salt type)= (Amount of carboxyl group)−(Amount of carboxyl group of H type)

(2) Whiteness

Evaluation was carried out in accordance with "Colour specification—Specification according to their three attributes" of JIS-Z-8721.

(3) Moisture absorbing rate (%)

Sample fiber (about 5.0 g) was dried at 105° C. for 16 hours using a hot-air drier to measure the weight (W1 grams). Then the sample was placed in a thermohygrostat of 20° C. temperature and 65% RH for 24 hours. Weight of the sample where from moisture was desorbed as such was measured (W2 grams). From the above results, calculation was conducted by the following formula.

$$(\text{Moisture absorbing rate } (\%))=[(W2-W1)/W1]\times 100$$

Example 1 and Comparative Example 1

An AN polymer (limiting viscosity [η] at 30° C. in dimethylformamide: 1.2) (10 parts) comprising 96% by weight of AN and 4% by weight of methyl acrylate (hereinafter, referred to as MA) was dissolved in 90 parts of a 48% aqueous solution of sodium rhodanide and the resulting original solution for spinning was subjected to spinning and elongation (total elongation rate: 10-fold) by a conventional manner and dried and wet-heated under the atmosphere of dry bulb/wet bulb=120° C./60° C. to give a material fiber which was a single fiber with fineness of 1.7 dtex.

The said material fiber was subjected to a treatment for the crosslink introduction at 98° C. for 5 hours in a 20% by weight aqueous solution of hydrazine hydrate. As a result of this treatment, crosslink was introduced and nitrogen content increased. Incidentally, amount of increased nitrogen was calculated from the difference after determining the nitrogen amounts by elementary analysis for the starting fiber and the fiber after introduction of crosslink.

After that, a hydrolyzing treatment was carried out at 90° C. for 2 hours in a 3% by weight aqueous solution of sodium hydroxide followed by washing with pure water. As a result of this treatment, 5.5 meq/g of carboxyl group of Na type were produced on and in the fiber.

The fiber after the said hydrolysis was subjected to a reducing treatment at 90° C. for 2 hours in a 1% by weight aqueous solution of sodium hydrosulfite (hereinafter, referred to as SHS) followed by washing with pure water. After that, a treatment with acid was carried out at 90° C. for 2 hours in a 3% by weight aqueous solution of nitric acid. As a result, all carboxyl groups of Na type produced in an amount of 5.5 meq/g were converted to carboxyl group of H type. The fiber after the said treatment with acid was poured into pure water, a 48% aqueous solution of sodium hydroxide was added so as to make Na neutralization degree 70 molar % to the carboxyl group of H type and a treatment for the adjustment to a salt type was carried out at 60° C. for 3 hours.

The fiber after the above steps was subjected to washing with water, application of oil thereto, dewatering and drying to give the moisture absorbing fiber with high whiteness of Example 1. Moisture absorbing rate, whiteness and color stability of the resulting fiber were checked and shown in Table 1 together with amount of carboxyl group of a salt type and amount of increased nitrogen. Incidentally, Comparative Example 1 is a moisture absorbing fiber which was prepared in the same manner as in Example 1 except that an AN polymer comprising 94% by weight of AN and 6% by weight of MA was used.

Examples 2 and 3

A moisture absorbing fiber with high whiteness of Example 2 was prepared by the same manner as in Example 1 except that the treatment for adjustment of a salt type was carried out by potassium hydroxide. Example 3 is that the fiber of Example 1 was treated with an aqueous solution of calcium chloride so that carboxyl group of Na type was converted to carboxyl group of Ca type. Characteristics of those fibers are also mentioned in Table 1.

Examples 4 and 5

Moisture absorbing fibers with high whiteness of Examples 4 and 5 were prepared by the same manner as in Example 1 except that a reducing agent was changed to the chemicals mentioned in Table 1. Characteristics of those fibers are also mentioned in Table 1. Incidentally, in the table, hydrazine hydrate and sodium thiosulfate are abbreviated as HH and STS, respectively.

Example 6

Moisture absorbing fiber with high whiteness was prepared by the same manner as in Example 1 except that sodium thiosulfate was used as an agent for reducing treatment and a treating condition for adjustment of salt type was changed so that the molar ratio of amount of carboxyl group of H type to amount of carboxyl group of Ca salt type was made 50/50. Here, the treatment for adjusting the salt type was carried out in such a manner that the treatment was conducted under the condition whereby Na neutralization rate became 50 molar % and then a treatment with aqueous solution of calcium chloride was conducted so that carboxyl group of Na type was converted to carboxyl group of Ca type. Characteristics of those fibers are also mentioned in Table 1.

Examples 7 and 8

Moisture absorbing fiber with high whiteness was prepared by the same manner as in Example 1 except that the fiber after the step for the treatment for introduction of crosslink using hydrazine hydrate was treated with acid at 90° C. for 2 hours in a 10% by weight aqueous solution of nitric acid before hydrolysis. The fiber of Example 8 was that the fiber of Example 7 was subjected to a method mentioned in Example 3 whereupon carboxyl group of Ca was achieved. Characteristics of those fibers are also mentioned in Table 1.

TABLE 1

| | | Ex 1 | Ex 2 | Ex 3 | Ex 4 | Ex 5 | Ex 6 | Ex 7 | Ex 8 | CE 1 |
|---|---|---|---|---|---|---|---|---|---|---|
| Monomer composition | — | AN/MA | AN/MA | AN/MA | AN/MA | AN/MA | AN/MA | AN/MA | AN/MA | AN/MA |
| in the starting fiber | wt % | 96/4 | 96/4 | 96/4 | 96/4 | 96/4 | 96/4 | 96/4 | 96/4 | 94/6 |
| Amount of increase nitrogen | wt % | 7.0 | 7.0 | 7.0 | 7.0 | 7.0 | 7.0 | 7.0 | 7.0 | 7.0 |
| Amt of COOH group of metal salt type | meq/g | 5.5 | 5.5 | 5.5 | 5.5 | 5.5 | 5.5 | 5.5 | 5.5 | 5.0 |
| Reducing agent | | SHS | SHS | SHS | STS | HH | STS | SHS | SHS | SHS |
| Type of metal salt | | Na | K | Ca | Na | Na | Ca | Na | Ca | Na |

TABLE 1-continued

| | | Ex 1 | Ex 2 | Ex 3 | Ex 4 | Ex 5 | Ex 6 | Ex 7 | Ex 8 | CE 1 |
|---|---|---|---|---|---|---|---|---|---|---|
| Molar ratio of H type/Metal salt type | %/% | 30/70 | 30/70 | 30/70 | 30/70 | 30/70 | 50/50 | 30/70 | 30/70 | 30/70 |
| Moisture absorbing rate | % | 35 | 32 | 27 | 36 | 35 | 20 | 35 | 28 | 33 |
| Whiteness | | | | | | | | | | |
| Lightness | | 9.5 | 9.0 | 9.5 | 9.0 | 9.0 | 9.0 | 9.5 | 9.5 | 8.5 |
| Chroma | | 1 | 2 | 1 | 2 | 2 | 2 | 1 | 1 | 3 |
| Hue | | 2.5 Y | 10 YR | 2.5 Y | 7.5 YR | 5 YR | 7.5 YR | 2.5 Y | 2.5 Y | 7.5 R |
| Color Stability | | | | | | | | | | |
| Durability against washing | grade | 4-5 | 4 | 4-5 | 4 | 3-4 | 4 | 4-5 | 4-5 | 3 |
| Durability against bleaching | grade | 3-4 | 3-4 | 3-4 | 3-4 | 3 | 3 | 4 | 4 | 2 |
| Stability against being allowed to stand | grade | 4-5 | 4 | 4 | 4 | 3-4 | 3-4 | 4-5 | 4-5 | 3 |
| Judgment | | ○ | ○ | ○ | ○ | ○ | ○ | ○ | ○ | x |

CE: Comparative Example

The moisture absorbing fiber with high whiteness of Example 1 showed 35% moisture absorbing rate and whiteness, chroma and hue were also as good as 9.5, 1 and 2.5Y, respectively. In addition, it is the fiber having excellent color stability where durability against bleaching, durability against washing and durability against being allowed to stand were grade 3-4, grade 4-5 and grade 4-5, respectively. In Examples 2 and 3 where metal salt type was different from Example 1, although moisture absorbing rate somewhat lowered as compared with Example 1, result of whiteness and color stability were as good as those of the fiber of Example 1. In Examples 4 and 5 where the reducing agent was different from Example 1, although whiteness and color stability were somewhat poor as compared with Example 1, they were still in a usable level. Moisture absorbing rate of Example 6 where the molar ratio of carboxyl group of H type was as high as 50% was 20% and all of moisture absorbing rate, whiteness and color stability were in a usable level.

In Examples 7 and 8 where the fiber subjected to a step of treatment for the introduction of crosslink was treated with acid before hydrolysis, although whiteness showed no big difference from Examples 1 and 3, color stability was far higher.

On the other hand, in Comparative Example 1, there was used a material fiber containing 6% by weight of MA which is an acrylate compound. Although its whiteness was good, color stability was inferior where durability against bleaching, durability against washing and durability against being allowed to stand were as poor as grade 2, grade 3 and grade 3, respectively and that was in such a level which might cause a problem in the practical use as a final product.

Examples 9 and 10

Moisture absorbing fibers with high whiteness of Examples 9 and 10 were prepared by the same manner as in Example 1 except that thiourea dioxide (hereinafter, referred to as UTO) was adopted as an agent for reducing treatment and composition of AN polymer was changed as shown in Table 2. Characteristics of those fibers are also mentioned in Table 2. Incidentally, vinyl acetate was abbreviated as VAC in the table.

Example 11

The moisture absorbing fiber with high whiteness of Example 11 was prepared by the same manner as in Example 10 except that concentration of hydrazine hydrate and treating time therefor which are conditions for the introduction of crosslink were adjusted so that the amount of increase nitrogen was made as shown in Table 2 and the condition for the treatment for adjusting the salt type was changed so that the carboxyl group of Na type was made 30 molar %. Characteristics of those fibers are also mentioned in Table 2.

Examples 12 and 13

The moisture absorbing fibers with high whiteness of Examples 12 and 13 were prepared by the same manner as in Example 1 except that UTO was used as an agent for reducing treatment and concentration of hydrazine hydrate and treating time therefor which are conditions for the introduction of crosslink were adjusted so that the amount of increase nitrogen was made as shown in Table 2. Characteristics of those fibers are also mentioned in Table 2.

TABLE 2

| | | Ex 9 | Ex 10 | Ex 11 | Ex 12 | Ex 13 |
|---|---|---|---|---|---|---|
| Monomer composition | — | AN/VAC | AN/MA | AN/MA | AN/MA | AN/MA |
| in the starting fiber | wt % | 90/10 | 98/2 | 98/2 | 96/4 | 96/4 |
| Amount of increase nitrogen | wt % | 7.0 | 7.0 | 3.0 | 2.0 | 9.0 |
| Amt of COOH group of metal salt type | meq/g | 5.0 | 5.5 | 8.8 | 8.5 | 4.2 |
| Reducing agent | | UTO | UTO | UTO | UTO | UTO |
| Type of metal salt | | Na | Na | Na | Na | Na |
| Molar ratio of H type/Metal salt type | %/% | 30/70 | 30/70 | 70/30 | 30/70 | 30/70 |
| Moisture absorbing rate | % | 35 | 37 | 24 | 43 | 31 |

TABLE 2-continued

| | | Ex 9 | Ex 10 | Ex 11 | Ex 12 | Ex 13 |
|---|---|---|---|---|---|---|
| Whiteness | | | | | | |
| Lightness | | 9.5 | 9.5 | 9.0 | 9.0 | 8.5 |
| Chroma | | 1 | 1 | 2 | 3 | 2 |
| Hue | | 2.5 Y | 7.5 YR | 10 YR | 2.5 Y | 5 R |
| Color Stability | | | | | | |
| Durability against washing | grade | 4-5 | 4 | 4 | 3-4 | 3-4 |
| Durability against bleaching | grade | 4 | 3-4 | 4 | 3-4 | 3 |
| Stability against being allowed to stand | grade | 4-5 | 4 | 4 | 3-4 | 3-4 |
| Judgment | | ○ | ○ | ○ | ○ | ○ |

Although Example 9 used a starting acrylic fiber containing no acrylate compound but containing 10% by weight of VAC and UTO was used as a reducing agent, moisture absorbing rate was as high as 35%, whiteness was also good that lightness, chroma and hue were 9.5, 1 and 2.5Y, respectively and color stability was also good that durability against washing, durability against bleaching and durability against being allowed to stand were grade 4-5, grade 4 and grade 4-5, respectively. Although Example 10 used a starting acrylic fiber containing 2% by weight of MA, higher moisture absorbing rate was available and high whiteness and excellent color stability were maintained. In Example 11, carboxyl group of Na type was made 30 molar % by a treatment for adjusting the salt type and, although the moisture absorbing rate was 24%, excellent whiteness and color stability were still maintained.

UTO was used as a reducing agent in Examples 12 and 13 where amounts of increased nitrogen were 2% and 9% by weight, respectively and amounts of carboxylic group of metal salt type were 8.5 and 4.2 meq/g, respectively. They maintained excellent whiteness and color stability.

Example 14

Moisture absorbing fiber with high whiteness of Example 14 was prepared by the same manner as in Example 9 except that treatment with acid and treatment for adjusting the salt type were not carried out after the reducing treatment. The characteristic of this fiber is shown in Table 3.

Example 15

Moisture absorbing fiber with high whiteness of Example 15 was prepared by the same manner as in Example 14 except that the fiber subjected to a step of treatment for introduction of crosslink by hydrazine hydrate was subjected to a treatment with acid in a 10% by weight aqueous solution of nitric acid at 90° C. for 2 hours. The characteristic of this fiber is also shown in Table 3.

Comparative Example 2

Moisture absorbing fiber of Comparative Example 2 was prepared by the same manner as in Example 1 except that the composition of the AN polymer was made AN/MA=93/7 and treatment with acid and treatment for adjusting the salt type after the reducing treatment were not carried out.

Comparative Examples 3 and 4

Fibers of Comparative Examples 3 and 4 were prepared by the same manner as in Comparative Example 2 except that hydrazine hydrate concentration and treating time in the condition for the treatment of introduction of crosslink were adjusted so that the amount of increased nitrogen became the amount as shown in Table 3 and that the agent for reducing treatment as shown in Table 3 was used. The characteristic of this fiber is also shown in Table 3.

Comparative Example 5

Moisture absorbing fiber of Comparative Example 5 was prepared by the same manner as in Example 1 except that reducing treatment, treatment with acid and treatment for adjusting the salt type were not carried out. The characteristic of this fiber is also shown in Table 3.

TABLE 3

| | | Ex 14 | Ex 15 | CE 2 | CE 3 | CE 4 | CE 5 |
|---|---|---|---|---|---|---|---|
| Monomer composition | — | AN/VAC | AN/VAC | AN/MA | AN/MA | AN/MA | AN/MA |
| in the starting fiber | wt % | 90/10 | 90/10 | 93/7 | 93/7 | 93/7 | 96/4 |
| Amount of increase nitrogen | wt % | 7.0 | 7.0 | 7.0 | 0.4 | 12.0 | 7.0 |
| Amt of COOH group of metal salt type | meq/g | 5.0 | 5.0 | 5.0 | 10.5 | 2.0 | 5.5 |
| Reducing agent | | UTO | UTO | SHS | UTO | SHS | none |
| Type of metal salt | | Na | Na | Na | Na | Na | Na |
| Molar ratio of H type/Metal salt type | %/% | 0/100 | 0/100 | 0/100 | 0/100 | 0/100 | 0/100 |
| Moisture absorbing rate | % | 42 | 41 | 40 | 60 | 10 | 42 |
| Whiteness | | | | | | | |
| Lightness | | 9.5 | 9.5 | 8.5 | 9 | 7 | 6 |
| Chroma | | 2 | 1 | 3 | 2 | 8 | 10 |
| Hue | | 10 YR | 7.5 YR | 7.5 R | 2.5 R | 5 R | 2.5 R |

TABLE 3-continued

| | | Ex 14 | Ex 15 | CE 2 | CE 3 | CE 4 | CE 5 |
|---|---|---|---|---|---|---|---|
| Color Stability | | | | | | | |
| Durability against washing | grade | 4 | 4 | 3 | 3 | 3-4 | 4-5 |
| Durability against bleaching | grade | 3 | 3-4 | 2 | 2 | 2-3 | 3-4 |
| Stability against being allowed to stand | grade | 3-4 | 4 | 2-3 | 2-3 | 3-4 | 4 |
| Judgment | | ○ | ○ | x | x | x | x |

CE: Comparative Example

Moisture absorbing rate of the moisture absorbing fiber with high whiteness of Example 14 showed 42% and there showed a sufficient whiteness that lightness, chroma and hue were 9.5, 2 and 10YR, respectively. Although its color stability was somewhat inferior to Example 9, it still showed sufficient property that durability against washing, durability against bleaching and durability against being allowed to stand were grade 4, grade 3 and grade 3-4, respectively. The fiber of Example 15 showed excellent moisture absorbing rate and whiteness as same as those in Example 14 and, in terms of color stability, it showed better stability than Example 14 that durability against washing, durability against bleaching and durability against being allowed to stand were grade 4, grade 3-4 and grade 4, respectively.

Although the fiber of Comparative Examples 2 and 3 showed good whiteness, color stability of the fibers was quite inferior and, in Comparative Example 3, the result was that its handling property upon being moisturized was bad and it was unable to be practically adopted. In the fiber of Comparative Example 4, moisturizing rate was as low as 10% and, in addition, its whiteness was not able to be said to be high because lightness, chroma and hue were 7, 8 and 5R, respectively. In Comparative Example 5, a reducing treatment was omitted and, therefore, the fiber was colored in red.

With regard to moisture absorbing fiber up to now, the product prepared by an art of Japanese Patent Laid-Open No. 2000/303,353 has been said to be a product in which moisture absorbing property and whiteness are well balanced. However, as a result of the present invention, it is now possible to provide a fiber having excellent color stability where moisture absorbing property is still maintained and no color change takes place even when bleaching in the dyeing step and repeated washing in the final product are repeated. The fiber according to the present invention can be advantageously used where its field of use is not limited. Incidentally it is an industrially advantageous point in the manufacture of the fiber of the present invention that even a fiber product in which the specific "metal salt type" of carboxyl group and the specific "molar ratio" of H type/metal salt type are once adjusted can be re-adjusted, if demanded, to "molar ratio" or "metal salt type" which is different from that in the said fiber product.

What is claimed is:

1. A moisture absorbing fiber-having high color stability against washing, bleaching and being allowed to stand, wherein said moisture absorbing fiber has been obtained by (1) treating acrylic fiber comprising acrylonitrile copolymer in which a (meth)acrylate compound as a copolymer component is less than 5% by weight, with a hydrazine compound whereby introduction of crosslink and increase in nitrogen content to an extent of 1.0~10.0% by weight is obtained, (2) treating the fiber of (1) with an aqueous solution of alkaline metal salt, whereby carboxyl group of a metal salt type by which CN group is hydrolyzed is produced in an amount of 4.0~10.0meq/g and (3) treating the fiber of (2) with a reduction treatment agent selected from the group consisting of hydrosulfite, thiosulfate, sulfite, nitrite, thiourea dioxide and an ascorbate compound, and wherein said moisture absorbing fiber has the following properties (a)-(c):

(a) discoloration of the fiber after washing according to a JIS-L0217-103 method, using "Attack" manufactured by Kao as detergent, for five times and evaluation by a grey scale for assessing staining according to JIS-L0805 being grade 4 or higher;

(b) discoloration of the fiber after bleaching with hydrogen peroxide where a bleaching treatment is carried out under the conditions of 0.5% by weight of hydrogen peroxide, pH 10 by NaOH, and a bath ratio of 1/50 at 80° C. for 60 minutes, and evaluation by a grey scale for assessing staining according to JIS-L0805 being grade 4; and (c) discoloration of the fiber after being allowed to stand in the co-presence of water in an amount of water that is more than saturated water absorption at 80° C. for 16 hours, and evaluation by a grey scale for assessing staining according to JIS-L0805 being grade 4 or higher.

2. The moisture absorbing fiber according to claim 1, wherein treating the fiber with an aqueous solution of alkaline metal salt is performed under an oxic (aerobic) atmosphere.

* * * * *